US009074167B2

(12) United States Patent
Song

(10) Patent No.: US 9,074,167 B2
(45) Date of Patent: Jul. 7, 2015

(54) COLOR ENHANCING DETERGENT FOR COLORED TEXTILE AND PREPARATION METHOD THEREFOR

(75) Inventor: Zikui Song, Changchun (CN)

(73) Assignee: Jilin Hengtai Garment Washing and Dyeing Science and Technology Institute, Changchun, Jilin (CN)

( * ) Notice: Subject to any disclaimer, the term of this patent is extended or adjusted under 35 U.S.C. 154(b) by 0 days.

(21) Appl. No.: 14/347,746

(22) PCT Filed: Sep. 28, 2011

(86) PCT No.: PCT/CN2011/080297

§ 371 (c)(1), (2), (4) Date: Mar. 27, 2014

(87) PCT Pub. No.: WO2013/044466

PCT Pub. Date: Apr. 4, 2013

(65) Prior Publication Data

US 2014/0235523 A1 Aug. 21, 2014

(51) Int. Cl.

| | |
|---|---|
| ***C11D 1/72*** | (2006.01) |
| ***C11D 3/395*** | (2006.01) |
| ***C11D 3/40*** | (2006.01) |
| ***C11D 3/42*** | (2006.01) |
| ***C11D 9/36*** | (2006.01) |
| ***C11D 3/39*** | (2006.01) |
| ***C11D 7/26*** | (2006.01) |
| ***D06P 5/02*** | (2006.01) |
| ***C11D 3/04*** | (2006.01) |
| ***C11D 3/18*** | (2006.01) |
| ***C11D 3/20*** | (2006.01) |
| ***C11D 3/22*** | (2006.01) |
| ***C11D 3/37*** | (2006.01) |
| ***C11D 3/43*** | (2006.01) |

(52) U.S. Cl.

CPC .. *C11D 3/42* (2013.01); *C11D 3/39* (2013.01); *C11D 3/395* (2013.01); *C11D 7/262* (2013.01); *D06P 5/02* (2013.01); *C11D 3/044* (2013.01); *C11D 3/046* (2013.01); *C11D 3/187* (2013.01); *C11D 3/2013* (2013.01); *C11D 3/2068* (2013.01); *C11D 3/2072* (2013.01); *C11D 3/2079* (2013.01); *C11D 3/227* (2013.01); *C11D 3/3723* (2013.01); *C11D 3/3726* (2013.01); *C11D 3/373* (2013.01); *C11D 3/3742* (2013.01); *C11D 3/40* (2013.01); *C11D 3/43* (2013.01)

(58) Field of Classification Search

CPC ..... C11D 1/72; C11D 3/0021; C11D 3/373; C11D 3/395; C11D 3/3951; C11D 3/40; C11D 3/42; C11D 11/0017; C11D 9/36

See application file for complete search history.

(56) References Cited

FOREIGN PATENT DOCUMENTS

| | | | |
|---|---|---|---|
| CN | 20091133746 | * | 4/2009 |
| CN | 101514304 A | | 8/2009 |
| CN | 102408950 A | | 4/2012 |

* cited by examiner

*Primary Examiner* — Charles Boyer

(74) *Attorney, Agent, or Firm* — Fredrikson & Byron, P.A.

(57) ABSTRACT

The present invention discloses a color-enhancing detergent for colored textile and a preparation method therefor. The color enhancing detergent for colored textile is composed of the following raw materials in parts by weight: a detergent, a deepening agent, a penetrating agent, a cationic modifier, a fiber modifier, a cellosolve, a diffusing agent, a dye fixing agent, a leveling agent, a dyeing auxiliary, a brightening agent, a bleaching agent, a pH-adjusting agent, and a bluing agent. The detergent can effectively fix the color of the colored textile that is washed and can deepen the original color as well.

15 Claims, No Drawings

COLOR ENHANCING DETERGENT FOR COLORED TEXTILE AND PREPARATION METHOD THEREFOR

RELATED APPLICATIONS

This application is a 35 U.S.C. 371 national stage filing from International Application No. PCT/CN2011/080297 filed Sep. 28, 2011, and claims priority thereto, the teachings of which are incorporated herein by reference.

TECHNICAL FIELD

The present invention relates to the technical field of detergent, and particularly to a color enhancing detergent for colored textile.

BACKGROUND ART

The existing cleansing products, such as detergent powder, detergent and the like, have functions of decontamination, detergent-action, grease removal, bleach, stain removal and the like, to a certain extent, for clothing. However, the phenomenon that color is removed occurs more or less for the clothing after the cleansing, for instance, the color is lightened, and the clothing looks like old. In the case that the color fastness of dye is relatively fine, after the cleansing for single time, when without color comparison reference, the color removal will be neglected. If cleansing frequency is high or the number of cleansings is accumulated to a certain amount, the color is faded and whitens as a whole, until the clothing is declared worthless due to cleansing. As an old saying, clothing becomes aged not by wearing but by washing. The so-called aging by washing means that the color is removed or faded.

DISCLOSURE OF THE INVENTION

Aiming to the deficiencies, the present invention provides a color enhancing detergent for colored textile, which effectively fixes the colors of the colored textile cleansed, and deepens the original colors as well.

To achieve the above purposes, the present invention provides the following technical solutions: a color enhancing detergent for colored textile, which consists of the following raw materials in parts by weight:

detergent: 5-95
deepening agent: 2-98
penetrating agent: 19-83
cationic modifier: 3-90
fiber modifier: 2-80
cellosolve: 1-81
diffusing agent: 2-82
dye fixing agent: 13-72
leveling agent: 11-76
dyeing auxiliary: 21-82
brightening agent: 22-69
bleaching agent: 29-75
pH-adjusting agent: 0.1-10
bluing agent: 0.006-0.08.

Preferably, the penetrating agent is fatty alcohol or epoxyethane.

Preferably, the dye fixing agent is dicyandiamide formaldehyde, organic silicon, cationic modified polyurethane, organic silicon of cationic reaction type, or formaldehyde-free organic silicon.

Preferably, the dyeing auxiliary is sodium chloride.

Preferably, the bleaching agent is aquae hydrogenii dioxidi or chlorine bleaching water.

Preferably, the pH-adjusting agent is acetic acid or caustic soda.

Preferably, the deepening agent is chitosan, resin or organic silicone oil.

Preferably, the cationic modifier is rare earth chloride compound, cupric salt, trivalent aluminum salt or trivalent chromic salt.

Preferably, the fiber modifier is rare earth compound.

Preferably, the diffusing agent is refined naphthalene or formaldehyde.

Preferably, the detergent is a detergent of cationic, anionic or non-ionic surface active agent.

Preferably, the leveling agent is $C_{12}$~$C_{18}$ fatty alcohol or epoxyethane.

Preferably, the bluing agent is benzidine, H acid or diazonium.

Preferably, the brightening agent is diaminostilbene disulfonic acid, cyanuric chloride, aniline or monoethanolamine.

Preferably, the organic silicone oil is alkyl silicone oil, aminosilicone oil, dimethyl silicone oil, fluorosilicone oil, polyether modified silicone oil or long chain alkyl silicone oil.

Preferably, the resin is organic fluororesin, organic silicon resin, polyamide resin or polyurethane resin.

Preferably, the cellosolve is butyl cellosolve, ethyl cellosolve, tert-butyl cellosolve or dimethyl cellosolve.

Preferably, the rare earth compound is a compound containing rare earth element, yttrium or scandium.

Preferably, the bluing agent contains 1%~3% of direct blue by weight.

The present invention also provides a method for preparing the above color enhancing detergent for colored textile, comprising the following steps:

(1) weighing the following raw materials in parts by weight:
detergent: 5-95
deepening agent: 2-98
penetrating agent: 19-83
cationic modifier: 3-90
fiber modifier: 2-80
cellosolve: 1-81
diffusing agent: 2-82
dye fixing agent: 13-72
leveling agent: 11-76
dyeing auxiliary: 21-82
brightening agent: 22-69
bleaching agent: 29-75
pH-adjusting agent: 0.1-10
bluing agent: 0.006-0.08;

(2) mixing the penetrating agent, the diffusing agent, the detergent, the cellosolve, the dye fixing agent, the leveling agent, the dyeing auxiliary, the brightening agent, the bleaching agent, and the bluing agent according to the parts by weight, at a temperature of 0~140° C., and adjusting the pH value to 1~14 by using the pH-adjusting agent, to prepare a detergent solution;

(3) adding into the detergent solution of Step (2) the cationic modifier, the fiber modifier and the deepening agent at a temperature of 0~140° C., and stirring it to obtain the color enhancing detergent for colored textile.

The deepening principle of the deepening agent used in the present invention is that the color of textile is determined by color phase, fineness, and lightness (gloss). With different color phases and glosses, if the reflectivity and transmissivity of the light waves are different, the shades and receiving-light degrees are different so as to present visual effects of light-and-shade and gradation. The textile gloss is resulted from the combination of positive and negative color light, surface reflected light and diffusion light from the inside. The textile gloss is primarily attributed to the reflected light. The main way to improve the color depth of the textile is reducing its ability of reflecting and diffusing light, such that more visual light enters inside the fibers and the dye is absorbed selectively to produce the effect of deepened color.

The deepening agent has the function of modifying the fiber surface optical properties. The deepening agent displays function by coating the fiber surface with a layer of low-reflectivity material which can form a film on the textile surface. Such film can change the degrees that the fiber absorbs, reflects and diffuses the light. Since the film formed on the fiber surface has different reflectivity and absorbability for the light, the brightness on the textile is somewhat reduced, and the color seems deepened. Even the macromolecule film is very thin, approximately 0.5 um, since the textile is combination of fibers and such influences of a great amount of fibers are overlapped, the resulting effect would be prominent. Therefore, as to color-removed textiles with higher brightness, the deepening effect is more obvious.

The deepening agent used is chitosan, resin or organic silicone oil, wherein the chitosan (also called deacetylated chitin) is formed by chitin being hydrolyzed in alkaline condition so as to be deacetylated. The chitin is obtained from shells of shellfish such as shrimp, crab and the like.

The organic silicone oil comprises alkyl silicone oil, aminosilicone oil, dimethyl silicone oil, SILANOL SF9188, SILANOLSF9103, fluorosilicone oil, polyether modified silicone oil or long chain alkyl silicone oil and the like.

The organic silicone oil is generally dimethyl silicone oil which is polysiloxane of chain structure with different polymerization degrees. The organic silicone oil is produced by that dimethyldichlorosilane is added with water to perform hydrolytic process to obtain the initial condensation poly annulus from which lower annulus is generated by splitting decomposition and rectification, and afterwards, the annulus, sealing agent and catalytic agent are telomerized to obtain various mixtures with different polymerization degrees which undergo the reduced pressure distillation to remove the low boiling substances.

The deepening principle of organic silicone oils is to reduce the light reflection on the textile surface by taking advantage of the low reflectivity of the organic silicone oils. Thus, the less the reflectivity, the better the deepening effect. Generally, organic silicone oils have the reflectivity of 1.40~1.45 wherein the fluorine-containing organic silicone oil has lower reflectivity below 1.38.

The resin generally refers to artificially synthesized solid medium with polystyrene as the substrate, which may be used as cation exchanger after being modified to have a sulfo group or hydroxyl, and as the anion exchanger when carrying primary or tertiary amino group.

The deepening principle of resin is: after being cleansed by the detergent containing resin, a uniform film of low reflectivity resin is formed on the textile surface, correspondingly reducing the reflectivity of the textile, such that the total reflected light of the textile surface is less than the reflected light before the cleansing, so as to deepen the color of the textile surface. The above mentioned deepening agent has the functions of fixing dye and changing the fiber fabric simultaneously, such as gentle degree, anti-static electricity, soil-releasing, antibiosis, non-ironing ability, and so on.

The fiber modifier is rare earth compound. The rare earth performs the modification on the fiber as follows: the rare earth can make the fiber expanded, and slacked in structure, and the textile after being cleansed by rare earth has clear longitudinal textures, the fibers present cylindrical form, the surface is clean, and the structure is loosen. By means of the activation and complexation effects for the dirt on the fibers, it is discomposed with besmirch containing N, O, or S elements and the like, to form complex compound to disperse in the solution after the cleansing, so as to increase capillary effect to have soft feel and improved textile appearance. The rare earth elements have strong complexing effect, and enter the amorphism area of the fibers, and form the complexing compound by means of coordinate bond and covalent bond, so as to function as crosslinking agent, to improve the mightiness of the textile.

The rare earth compounds contain various compounds of 15 rare earth elements, yttrium and scandium. From the chloride of 46% pureness to single rare earth oxide of 99.9999% and the rare earth metal, the rare earth is in the form of red or black crystallization or block shape substance, which is solvable in water and easily affected with damp. It produces hydroxide or oxychloride sediment with alkali. The aqueous solution reacts with oxalic acid to generate oxalic acid rare earth sediment, and reacts with sodium sulfate or ammonia sulfate to generate rare earth sodium sulfate double salt sediment or rare earth ammonia sulfate double salt sediment.

The return-new principle of the rare earth is as follows: the cleansing return-new effect of the rare earth element on the textile lies at: the whiteness of the textile is increased, the color is deepened and brighter, capillary effect is improved and the mightiness is enhanced, and so on. The rare earth element can make the color substances of the dirt on the fiber activated, such that it becomes easier to react with the bleaching agent, to reduce the activation energy of the bleaching reaction, that is, it has catalytic activity effect for the bleaching reaction. The rare earth element itself has the maximum absorbing wave length of 580 um, with the ability to selectively absorb yellow light of the old clothing, such that the yellowed old clothing returns new. Complexing action is between the rare earth and the hydroxyl oxygen atom of the dye molecule and between nitrogen-atom of azo group and oxygen atom of sulfonic acid group, so as to increase the molecular weight of the dye, such that the dye color is deepened and the color brightness is improved. The rare earth is a kind of color deepening and brightening agent. The rare earth can increase the molecular force between the dye and nonpolar part of the fibers, to increase the color fastness. Therefore, the textile cleansed by rare earth has deepened and bright color, and pure color light, and high color fastness.

The cationic modifier has the main components of organic metal ionic compound and nitrogen-containing cationic compound. It comprises: rare earth chloride compound, cupric salt, trivalent aluminum salt or trivalent chromic salt and so on. It has electrostatic attraction and complexing action with the fibers, changing the electronegativity of the textile and reducing electrostatic repulsion force between the fiber and the anion dye, so as to make the absorption of fibers to dye more firmed, such that the fixation degree of the dye on the fibers is increased, to prevent dissolution of the dye due to cleansing, and sublimation of the dye during wearing.

The rare earth chloride has the molecular formula of $RECl_3.6H_2O$ and molecular weight of 354.4, which mainly refers to rare earth mineral primarily including light rare earth, and it undergoes alkaline process and acid process, and is $P_2O_4$ grouped, to obtain the mixture of light rare earth chloride, which contains lanthanum chloride, cerium chloride, praseodymium chloride, Rubidium chloride and the like.

The cellosolve is butyl cellosolve, ethyl cellosolve, tert.-butyl cellosolve or dimethyl cellosolve. The butyl cellosolve has the molecular formula of $C_6H_{14}O_2$, capable of being solved in water of 20 times, and solved in most organic solution and mineral oil, and it has very high dilution ratio with petroleum hydrocarbon, with the effects of improving emulsification performance and making the mineral substance solved in the detergent. Using such ability, it is possible that the mineral substance, mineral salt and polar dust etc. deposited and absorbed on the fiber surface are solved and released, such that the fibers return new.

The aquae hydrogenii dioxidi is hydrogen peroxide, the aqueous solution of which is commonly called oxydol. The appearance of it is colorless clear liquid, which is a kind of strong oxidizer and good bleaching agent.

The sodium chloride is mineral salt and also chloride, which is colorless cubic crystal or white crystal, and is a good dyeing auxiliary.

The chlorine bleaching water, also called bleaching agent, is oxidant capable of releasing active chlorine, generally comprising chlorine bleaching water and chlorine bleaching powder. It uses the oxidation of sodium hypochlorite to destroy dirt pigment and besmirch structure to achieve the purpose of returning new.

The dye fixing agent is aqueous gel separated out by the contact between polymer solution of repeating unit consisting of cation group and alkaline aqueous solution. Such aqueous gel and heavy metal ion and pigment can be absorbed with each other, and form a film on it after drying, which has fixing protection effect to the dye.

Compared with the prior art, the present invention adds various auxiliary materials of certain amount into the existing detergent, such as the deepening agent, the penetrating agent, the cationic modifier, the fiber modifier, the diffusing agent, the dye fixing agent, the leveling agent, the dyeing auxiliary, the brightening agent, the bleaching agent, the pH-adjusting agent, and the bluing agent. With the colored textile being cleansed, not only the original color is fixed, but also the color after cleansing is deepened under the effect of the deepening agent. The faded color after each cleansing is restored by the color deepening, such that the clothing still remains the original color, that is, the color is not faded, and does not look like old. With the colored textile being cleansed for more times, the color remains unchanged all the time, achieving the effect of being always new by frequent cleansing, which is the characteristic of product of "color deepening detergent".

This product is environment friendly without pollution. The clothing after cleansing is fresh and clean, as well as deepened in color and brighter, achieving effect of returning new. Thus, it is prevented that the clothing turned old or that the clothing is declared worthless, shifted out and renewed due to cleansing. Therefore, a large amount of textile sources, energy, labors, and cost for buying new clothing can be saved for society.

DETAILED DESCRIPTION OF THE PREFERRED EMBODIMENTS

The present invention will be described in detail in conjunction with embodiments below, which is only for the exemplary and explanatory purpose, and not intended to limit the protection scope of the present invention in any way.

Embodiment 1

A color enhancing detergent for colored textile, consists of the following raw materials in parts by weight:

anion surface active detergent: 95
chitosan: 2
fatty alcohol: 83
cationic modifier: 3
rare earth compound: 80
butyl cellosolve: 1
refined naphthalene: 19
dicyandiamide formaldehyde: 72
epoxyethane: 11
sodium chloride: 82
diaminostilbene disulfonic acid: 22
chlorine bleaching water: 75
acetic acid: 0.1
benzidine: 0.08.

The preparation method of the above detergent comprises the following steps:

(1) weighing the above raw materials in parts by weight;

(2) mixing the penetrating agent, the diffusing agent, the detergent, the cellosolve, the dye fixing agent, the leveling agent, the dyeing auxiliary, the brightening agent, the bleaching agent, and the bluing agent according to the parts by weight, at the temperature of 0° C., and adjusting the pH value to 14 by using the pH-adjusting agent, to prepare detergent solution;

(3) adding into the detergent solution of Step (2) the cationic modifier, the fiber modifier, and the deepening agent at the temperature of 140° C., and stirring it to obtain the color enhancing detergent for colored textile.

Embodiment 2

A color enhancing detergent for colored textile, consists of the following raw materials in parts by weight:

Non-ion surface active detergent: 5
organic silicone resin: 98
fatty alcohol: 19
cationic modifier: 90
butyl cellosolve: 50
rare earth compound: 2
formaldehyde: 2
organic silicone: 13
Epoxyethane: 15
sodium chloride: 21
aniline: 69
aquae hydrogenii dioxidi: 29
acetic acid: 10
H acid: 0.006.

The preparation method of the above detergent comprises the following steps:

(1) weighing the above raw materials in parts by weight;

(2) mixing the penetrating agent, the diffusing agent, the detergent, the cellosolve, the dye fixing agent, the leveling agent, the dyeing auxiliary, the brightening agent, the bleaching agent, and the bluing agent according to the parts by weight, at the temperature of 140° C., and adjusting the pH value to 1 by using the pH-adjusting agent, to prepare detergent solution;

(3) adding into the detergent solution of Step (2) the cationic modifier, the fiber modifier, and the deepening agent at the temperature of 0° C., and stirring it to obtain the color enhancing detergent for colored textile.

Embodiment 3

A color enhancing detergent for colored textile, consists of the following raw materials in parts by weight:

anion surface active detergent: 50
organic silicone oil: 48
fatty alcohol: 53
cationic modifier: 46
tertiary butyl cellosolve: 80
rare earth compound: 40
refined naphthalene: 48
dicyandiamide formaldehyde: 42
epoxyethane: 43
sodium chloride: 53
monoethanolamine: 46
chlorine bleaching water: 53
acetic acid: 5
diazonium: 0.043.

The preparation method of the above detergent comprises the following steps:

(1) weighing the above raw materials in parts by weight;
(2) mixing the penetrating agent, the diffusing agent, the detergent, the cellosolve, the dye fixing agent, the leveling agent, the dyeing auxiliary, the brightening agent, the bleaching agent, and the bluing agent according to the parts by weight, at the temperature of 40° C., and adjusting the pH value to 6 by using the pH-adjusting agent, to prepare detergent solution;
(3) adding into the detergent solution of Step (2) the cationic modifier, the fiber modifier, and the deepening agent at the temperature of 80° C., and stirring it to obtain the color enhancing detergent for colored textile.

Embodiment 4

A color enhancing detergent for colored textile, consists of the following raw materials in parts by weight:

Non-ion surface active detergent: 45
Chitosan: 38
Epoxyethane: 53
dimethyl cellosolve: 10
cationic modifier: 60
rare earth compound: 70
formaldehyde: 72
organic silicone: 52
Epoxyethane: 26
sodium chloride: 62
cyanuric chloride: 59
chlorine bleaching water: 55
caustic soda: 8
benzidine: 0.052.

The preparation method of the above detergent comprises the following steps:

(1) weighing the above raw materials in parts by weight;
(2) mixing the penetrating agent, the diffusing agent, the detergent, the cellosolve, the dye fixing agent, the leveling agent, the dyeing auxiliary, the brightening agent, the bleaching agent, and the bluing agent according to the parts by weight, at the temperature of 80° C., and adjusting the pH value to 8 by using the pH-adjusting agent, to prepare detergent solution;
(3) adding into the detergent solution of Step (2) the cationic modifier, the fiber modifier, and the deepening agent at the temperature of 20° C., and stirring it to obtain the color enhancing detergent for colored textile.

Experimental Embodiment 5

The color enhancing detergents for colored textile obtained in the above embodiments is tested by the following use method:

1. Immersion cleansing: a certain amount (0.1~100 ml) of color enhancing detergent obtained in the above embodiments is solved in a certain amount (1 ml~100 ml) of warm water (0~70° C.), and stirring evenly, to generate color enhancing detergent mother liquid. A certain amount (1 ml~100 ml) of water is added to form color enhancing detergent solution, and the temperature is kept at 0~100° C. The object to be cleansed (1 g~1000 g) is placed into the detergent solution, and undergoes the hand-washing or machine-washing for 1~100 min, dewatering, and iron dry (50~1000° C.), oven dry (0~200° C.) or natural drying.

2. Spraying: the color enhancing detergent mother liquid is produced by the method mentioned in the above use method 1, and sprayed at the temperature of 0~100° C. with a mist generator onto the dry clothing to be cleansed and maintained in hygrometric state for 1~100 mins, and the clean water washing is performed for 1~30 times, and the dewatering, and the iron dry, the oven dry or natural drying as mentioned in method 1 are performed.

Compared with the cleansed clothing without using the detergent of the embodiments of the present invention, Table 1 is shown as follows:

TABLE 1

Color comparison after 10 times of washing

| | | Embodiment 1 | Embodiment 2 | Embodiment 3 | Embodiment 4 | Compared Example |
|---|---|---|---|---|---|---|
| color of cleansed clothing | red | red | red | red | red | light red |
| | yellow | yellow | bright yellow | yellow | yellow | light yellow |
| | white | white | white | white | white | grayish white |
| | blue | blue | blue | blue | blue | light blue |
| | purple | purple | purple | purple | purple | light purple |
| | black | black | black | black | black | Light black |

The above is the preferable embodiments of the present invention. It should be noted that as for one skilled in the art, without departing from the principle of the present invention, several improvements and modifications may be made which should be deemed to be covered by the protection scope of the present invention.

What is claimed is:

1. A color enhancing detergent for colored textile, consisting of the following raw materials in parts by weight:

detergent: 5-95
deepening agent: 2-98
penetrating agent: 19-83
cationic modifier: 3-90
fiber modifier: 2-80
cellosolve: 1-81
diffusing agent: 2-82
dye fixing agent: 13-72
leveling agent: 11-76
dyeing auxiliary: 21-82
brightening agent: 22-69
bleaching agent: 29-75
pH-adjusting agent: 0.1-10
bluing agent: 0.006-0.08.

2. The color enhancing detergent for colored textile according to claim 1, characterized in that the deepening agent is chitosan, resin or organic silicone oil, and the detergent is a detergent of cationic, anionic or non-ionic surface active agent.

3. The color enhancing detergent for colored textile according to claim 1, the cellosolve is butyl cellosolve, ethyl cellosolve, tert.-butyl cellosolve or dimethyl cellosolve, the cationic modifier is rare earth chloride compound, cupric salt, trivalent aluminum salt or trivalent chromic salt, and the fiber modifier is rare earth compound.

4. The color enhancing detergent for colored textile according to claim 1, the dyeing auxiliary is sodium chloride, the bleaching agent is hydrogen peroxide or chlorine bleaching water, and the brightening agent is diaminostilbene disulfonic acid, cyanuric chloride, aniline or monoethanolamine.

5. The color enhancing detergent for colored textile according to claim 1, characterized in that the penetrating agent is fatty alcohol or epoxyethane.

6. The color enhancing detergent for colored textile according to claim 1, characterized in that the dye fixing agent is dicyandiamide formaldehyde, organic silicon, cationic modified polyurethane, organic silicon of cationic reaction type, or formaldehyde-free organic silicon.

7. The color enhancing detergent for colored textile according to claim 1, characterized in that the pH-adjusting agent is acetic acid or caustic soda.

8. The color enhancing detergent for colored textile according to claim 1, characterized in that the diffusing agent is refined naphthalene or formaldehyde.

9. The color enhancing detergent for colored textile according to claim 1, characterized in that the leveling agent is $C_{12}$~$C_{18}$ fatty alcohol or epoxyethane.

10. The color enhancing detergent for colored textile according to claim 1, characterized in that the bluing agent is benzidine, H acid or diazonium.

11. The color enhancing detergent for colored textile according to claim 2, characterized in that the organic silicone oil is alkyl silicone oil, aminosilicone oil, dimethyl silicone oil, fluorosilicone oil, polyether modified silicone oil or long chain alkyl silicone oil.

12. The color enhancing detergent for colored textile according to claim 2, characterized in that the resin is organic fluororesin, organic silicon resin, polyamide resin or polyurethane resin.

13. The color enhancing detergent for colored textile according to claim 3, characterized in that the rare earth compound is a compound containing rare earth element, yttrium or scandium.

14. The color enhancing detergent for colored textile according to claim 1, characterized in that the bluing agent contains 1%-3% of direct blue by weight.

15. A method for preparing the color enhancing detergent for colored textile according to claim 1, comprising the following steps:

(1) weighing the following raw materials in parts by weight:
detergent: 5-95
deepening agent: 2-98
penetrating agent: 19-83
cationic modifier: 3-90
fiber modifier: 2-80
cellosolve: 1-81
diffusing agent: 2-82
dye fixing agent: 13-72
leveling agent: 11-76
dyeing auxiliary: 21-82
brightening agent: 22-69
bleaching agent: 29-75
pH-adjusting agent: 0.1-10
bluing agent: 0.006-0.08;

(2) mixing the penetrating agent, the diffusing agent, the detergent, the cellosolve, the dye fixing agent, the leveling agent, the dyeing auxiliary, the brightening agent, the bleaching agent, and the bluing agent according to the parts by weight, at a temperature of 0~140° C., and adjusting the pH value to 1~14 by using the pH-adjusting agent, to prepare detergent solution;

(3) adding into the detergent solution of Step (2) the cationic modifier, the fiber modifier, and the deepening agent, at a temperature of 0~140° C., and stirring it to obtain the color enhancing detergent for colored textile.

* * * * *